United States Patent [19]

Pensel

[11] 3,987,743

[45] Oct. 26, 1976

[54] BOAT WITH SKIS

[76] Inventor: Donald G. Pensel, Star Rte., Glens Falls, N.Y. 12801

[22] Filed: Aug. 28, 1975

[21] Appl. No.: 608,713

Related U.S. Application Data

[63] Continuation of Ser. No. 441,985, Feb. 13, 1974, abandoned.

[52] U.S. Cl. ..... 114/66.5 R

[51] Int. Cl.[2] ..... B63B 1/14

[58] Field of Search ..... 114/66.5 R, 66.5 P, 114/66.5 F, 67 R, 61; 115/70; 9/1 T; 244/101, 105, 108

[56] References Cited

UNITED STATES PATENTS

| | | | |
|---|---|---|---|
| 3,146,752 | 9/1964 | Ford | 114/66.5 R |
| 3,401,663 | 9/1968 | Yost | 114/66.5 R |
| 3,636,907 | 1/1972 | Scarritt, Sr. | 114/66.5 R |
| 3,670,684 | 6/1972 | Helker | 114/66.5 R X |

*Primary Examiner*—Stephen G. Kunin
*Assistant Examiner*—Sherman D. Basinger
*Attorney, Agent, or Firm*—Cushman, Darby & Cushman

[57] ABSTRACT

A pair of skis are attached along either side of an outboard marine vehicle and are used to smooth the ride of the marine vehicle by decreasing resistance between the vehicle and water. Each ski is attached to the marine vehicle by a coil spring, a shock absorber, and a trailing arm connected at a substantially central pivotal point on the ski and further attached to a mounting plate on the side of the vehicle. The coil spring provides for a resiliency of the ski with respect to the marine vehicle, and substantial impacts between the water surface and the marine vehicle are absorbed in the spring, with the shock absorber damping out excessive vibrations. The trailing arm prevents substantial movement of the ski in a horizontal plane with respect to the marine vehicle, and a further elastic member or spring is attached to a front portion of each ski and the marine vehicle to ensure that the tip of the skis will not inadvertently fall below the surface of the water.

2 Claims, 4 Drawing Figures

BOAT WITH SKIS

This is a continuation of application Ser. No. 441,985 filed Feb. 13, 1974 and now abandoned.

BACKGROUND OF THE INVENTION

1. Field of the Invention

This invention pertains to marine vehicles, and more particularly to a marine vehicle provided with skis that are disposed on either side thereof. Such skis could advantageously be adapted to a suitably designed outboard runabout and could also readily be adapted for use with other types of marine vehicles such as inboard, inboard-outboards, air cushion boats, workboats, yachts, or even large military vessels and ships.

When a marine vehicle such as an outboard runabout is accelerated, and depending on the speed of the vehicle and the roughness of the water, the vehicle's hull has a tendency to pound roughly against the surface of the water. The result of such a jarring ride may have an adverse effect upon the occupants, the hull and the cargo of the runabout. The present invention is utilized to overcome such a problem by employing resilient means between the skis and the vehicle.

2. Description of the Prior Art

Providing a marine vehicle with skis on the port and starboard sides is disclosed in the prior art, as set forth in U.S. Pat. No. 3,308,780. In this patent, a hydroski vehicle is shown with skis disposed on both sides of the vehicle's hull, and each of the skis further provides for attachment of suitable power plants. Each ski may be raised and lowered by virtue of a hydraulic cylinder which rotates a series of links connected to the ski. The tip of each ski is secured to the vehicle by means of pivotal struts. While U.S. Pat. No. 3,308,780 sets forth a ski structure on a marine vehicle, no provision is made for the skis absorbing substantial impacts through the use of a resilient means. The present invention as contemplated by the applicant distinquishes over U.S. Pat. No. 3,308,780 by recognizing the need for a shock absorbing structure to be utilized between the marine vehicle and the skis.

In U.S. Pat. No. 3,118,411, there is disclosed an aero-glide boat which utilizes aerodynamic phenomena in providing principal support of the vehicle at cruising speeds. Wings are utilized to provide for lifting the vehicle to cruising condition. Here again, there is no provision for skis being secured by resilient means to the marine as set forth in applicant's invention.

SUMMARY OF THE INVENTION

It is therefore an object of this invention to provide a marine vehicle with skis, such that the skis will smooth the ride of the marine vehicle.

Another object of the invention is to adapt the skis to the marine vehicle so that the vehicle's hull will be lifted to a higher level out of the water than would occur if the skis were not utilized. More particularly, the bottom of the hull will be raised to a level slightly lower than the surface of the water.

Still another object is to provide a hull elevated by skis so that less water is displaced by the hull, thus decreasing the friction between the water and the hull when the marine vehicle is traveling over rough water.

A further object is to provide the skis with resilient means or springs to absorb major shocks between the skis and the hull and also to provide shock absorbers located adjacent to the springs to damp vibrations from the springs.

Yet a further object is to provide a marine vehicle with skis in which the skis are adapted to travel parallel to the hull, and not to be deflected in a direction outwardly or inwardly from the hull, thus ensuring that the steering response of the boat is accurate.

Additional objects of the present invention reside in the specific construction of the exemplary apparatus hereinafter particularly described in the specification and shown in the several drawings.

BRIEF DESCRIPTION OF THE DRAWINGS

Further additional objects and advantages will become apparent as consideration is given to the following detailed description of a preferred embodiment of the invention as is illustrated in the accompanying drawings forming part of this specification wherein.

DETAILED DESCRIPTION OF THE INVENTION

Figure 1:
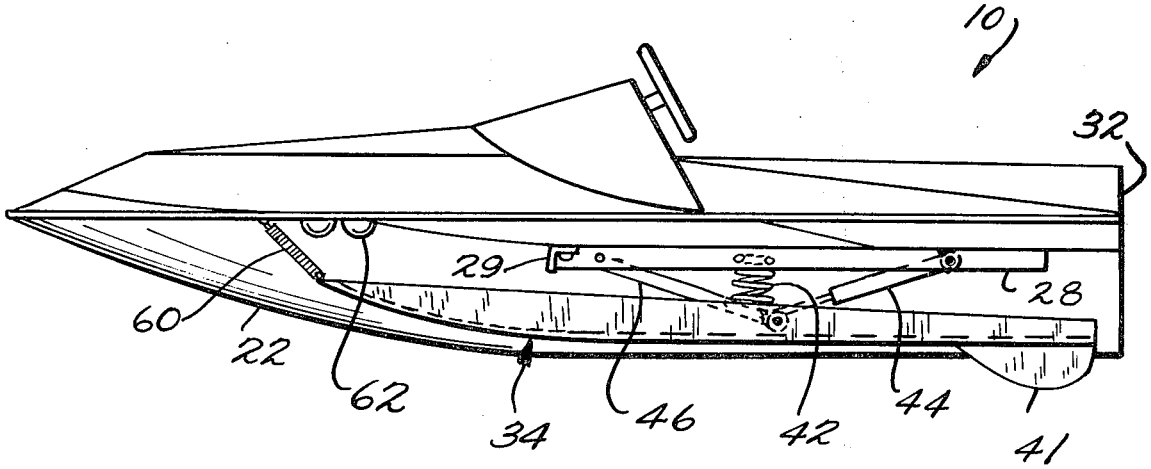
FIG. 1 is a side view of the marine vehicle showing a ski on the port side along with the coil spring, shock absorber, trailing arm means and small spring at the front tip of the ski.
Figure 2:
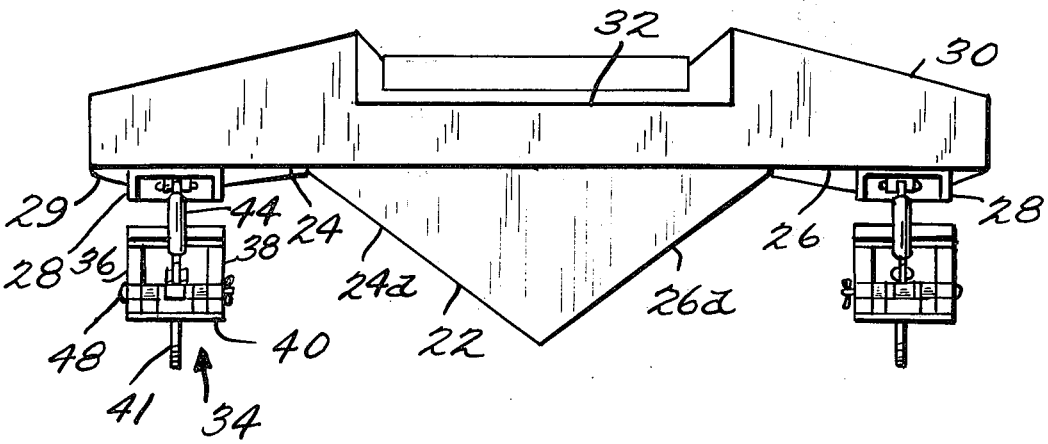
FIG. 2 is a rear view of FIG. 1 of the marine vehicle, illustrating a V-shaped hull and overhanging side or deck portions.

Referring to FIGS. 1 and 2, there is illustrated the preferred embodiment of the invention, i.e., a marine vehicle generally designated at 10, having a central V-shaped hull 22, a port side 24, and a starboard side 26. In FIG. 2 the preferred embodiment shows the port side 24 and starboard side 26 as extending outwardly over the hull 22, to provide a surface so that mounting plates 28 may be secured in a horizontal position. It should be noted, however, that the plates 28 could be secured directly to the port side **24*a* and starboard side 26*a* of the hull by any suitable attaching method. The overhanging deck 30, shown in FIG. 2, is also constructed with a transom 32** to serve as an outboard motor (not shown) securing support.

Figure 4:
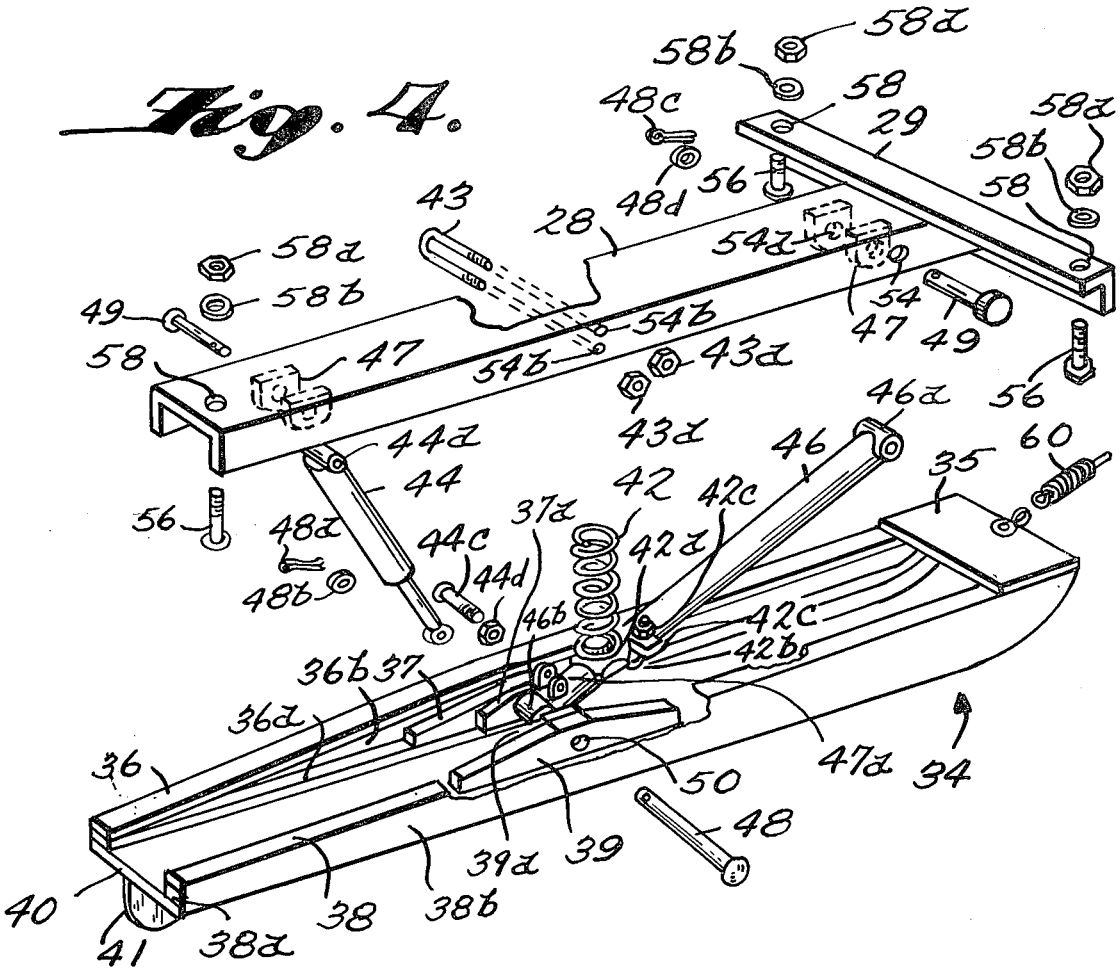
FIG. 4 is an exploded view of the mounting apparatus of the ski, and further illustrates the relationship of a mounting bracket, coil spring, shock absorber, and trailing arm means.

From a viewing of FIG. 4, it can be seen that each ski 34 is constructed with four wood stringers 36. **36*a*, 38 and 38*a*. Stringers 36 and 36*a* are bent to fit a plywood side panel 36*b*. Stringers 36 and 36*a* are secured to panel 36*b* by screws and glue. Stringers 38 and 38*a* are similarly attached to side panel 38*b*. A bottom plate 40 is secured to stringers 36*a* and 38*a* by means of screws, glue, etc. to hold the ski assembly together. Plywood, aluminum or other suitable materials could be used in the construction, and ski 34 could also be of one piece molded construction. If it is desired to give the ski 34 greater floatation characteristics, the ski could be made as an air-tight compartment or could be filled with foam floatation material. A buoyant ski would be advantageous in conjunction with the preferred embodiment which has an outwardly extending port side 24 and starboard side 26. Such buoyant skis would raise the level of the marine vehicle when it was not traveling. Each ski is attached to the underside of the boat by means of a mounting plate 28, a resilient means such as a coil spring 42, a shock absorber 44, and a stabilizing or trailing arm means 46. The trailing arm means 46 are employed to prevent the skis 34 from substantial movement in a horizontal plane relative to the marine vehicle. Fins 41, hereinafter described, also provide for stabilizing skis 34. The mounting plate 28 can be constructed of a piece of U-shaped channel, preferably made of steel. The plate 28 is secured to the sides 24 and 26 by means of carriage bolts 56 that are inserted through plate holes 58 drilled or punched in the plate 28 at appropriate locations. An angle or cross-member 29 (preferably of steel construction) is welded to channel member or mounting plate 28 at a forward end thereof. Cross-member 29 is also provided with holes 58 so that carriage bolts 56 may be inserted therethrough and secured to the outwardly extending port side 24 and starboard side 26, by means of typical nuts and washers, 58***a* and 58*b*, respectively.

Referring again to FIG. 4, further details of the novel ski construction are illustrated. Each ski 34 has side portions or halves which are constructed from a pair of stringers 36 and 36*a*, and 38 and 38*a*, as previously described. A stabilizing fin 41 is secured by screws to the bottom plate 40 at a rearward position thereof. The fins 41 provide for further stability in that they aid the skis 34 in tracking along a straight path, that is, the fins 41 prevent the skis 34 from substantial movement in a horizontal plane with respect to the marine vehicle.

As disclosed hereinbefore, the skis may be constructed of plywood. Wood reinforcing stringers 37 and 39 are secured as by gluing, etc., to stringers 36*a* and 38*a*, respectively. Attached to the stringers 37 and 39 are wood spacers 37*a* and 39*a*. Trailing arm 46 is constructed with a bronze bearing end 46*b* which is designed to fit between the spacers 37*a* and 39*a*. A pin 48 is inserted through a hole 50 in halves 36 and 38. Pin 48 also passes through stringers 37 and 39 and through spacers 37*a* and 39*a*. The end 46*b* also has holes to allow passage of the pin 48. With the pin 48 fully inserted through lower end 46*b* and through hole 50, a cotter pin 48*a* and washers 48*b* are used to secure the pin 48 to the ski 34. Thus, it can be readily appreciated that pin 48 and hole 50 provide a pivot point for the ski 34. The pivot point may be most advantageously located at a position intermediate of the length of the ski 34.

Another bronze bearing 46*a* is located at the other end of the trailing arm 46, and is secured to the mounting plate 28 by means of welded attaching plates 47 constructed with holes 54*a* to permit pin 49 to pass through plate holes 54 and end 46*a*. Another cotter pin 48*c* and washer 48*d* are used to retain pin 49 in place.

Welded to an upper surface of arm 46 is another attaching plate 47*a*, of generally U-shaped design, which secures shock absorber 44 to the arm 46 by means of a bolt and nut, 44*c* and 44*d*, respectively. Upper end *a* of shock absorber 44 is held to plate 28 by means of further attaching plates 47, arranged to allow passage of a pin 49 therethrough and secured by a cotter pin similar to the attaching means of the arm 46.

The coil spring 42 is secured to the trailing arm 46 by means of a spring bracket 42*a* and a U-bolt 42*b* fastened by appropriate U-bolt nuts 42*c* and a U-bolt adapter 42*d*. The upper end of the spring is secured to plate 28 by means of another U-bolt 43 and nuts 43*a*. U-bolt 43 is passed through an upper coil of spring 42, and then passed through holes 54*b* in one flange of channel 28. Nuts 43*a* secure U-bolt 43 to channel 28.

A plywood bumper plate 35 is fixed to the top front portion of the ski 34 to provide for a surface to contact absorbing pads 62. Absorbing pads 62 cushion the upward impact of the ski 34 against the marine vehicle. Such pads 62 could be made of any suitable cushioning material. An elastic means such as a small tension spring 60, as shown in FIG. 1, is used to keep the tip of the ski 34 from swinging downward in a vertical plane, particularly when the boat is stationary. The spring 60 has one end secured to bumper plate 35 and the other end secured to the marine vehicle, and will allow the ski 34 to move in a vertical plane about the hole 50, which serves as a pivot point, as previously described.

The springs 42 are so designed that when the marine vehicle is normally loaded and traveling over relatively smooth water, the bottom of the hull 22 will be lifted to protrude approximately 2 inches beneath the level of the skis 34, as shown in FIGS. 1 and 2. Also, during this operating condition, the springs 42 are in a somewhat compressed state, but are still disposed to absorb large shocks as when rough water or wave action is encountered. The shock absorbers 44 are utilized to damp out excessive vibrations in the springs 42 after the springs 42 have absorbed substantial shocks.

Figure 3:
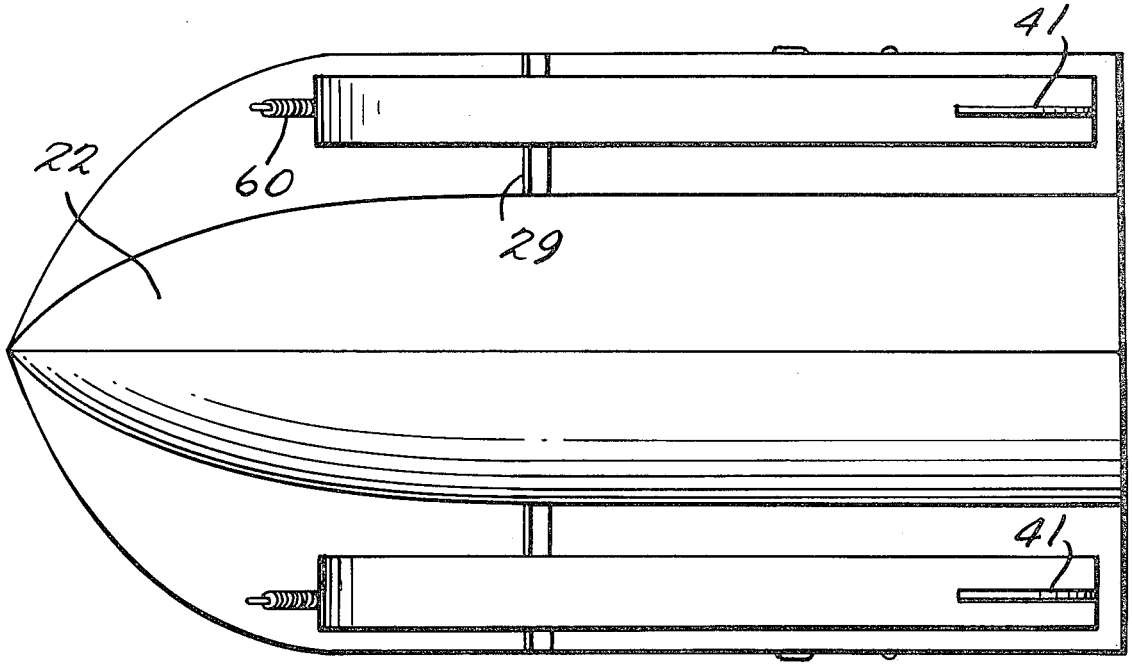
FIG. 3 illustrates a bottom view of the marine vehicle, and shows the arrangement of the skis near the outer sides or deck of the marine vehicle.

In FIG. 3 a bottom view of the marine vehicle is shown, and it should be noted that the skis 34 are placed near outer edges of the port 24 and starboard 26 sides, thus increasing stability of the boat.

The foregoing specific embodiment has been described for the purpose of illustrating the principles of the present invention, and the same is subject to modification without departure therefrom. Therefore, the invention includes all modifications that could be effected within the scope and spirit of the appended claims.

What is claimed is:

1. A marine vehicle having a central hull having a long axis and having port and starboard sides, comprising a. a pair of ski mounting means on said marine vehicle, one of said mounting means disposed on said port side and the other of said mounting means disposed on said starboard side;

b. a pair of skis, each ski having a long axis, one of said skis disposed beneath said mounting means on said port side, and the other of said skis disposed beneath said mounting means on said starboard side;

c. a pair of resilient means for allowing movement of said skis in a vertical plane relative to the length of said marine vehicle and for absorbing impacts transferred from the surface of a body of water to said marine vehicle when said vehicle is traveling over the surface of a body of water, one of said resilient means disposed on said port side and the other of said resilient means disposed on said starboard side, each of said resilient means having one end thereof positioned to act on a ski at a position substantially intermediate of the length of said ski, and the opposite end positioned to act on a mounting means on said marine vehicle; and wherein said resilient means for normal loads lifts the bottom of said central hull such that it protrudes just below the surface of a body of water;

d. a pair of stabilizing means for preventing said skis from substantial movement in a horizontal plane relative to said marine vehicle, one of said stabilizing means disposed on said port side and the other of said stabilizing means disposed on said starboard side, each of said stabilizing means being pivotally connected to an adjacent ski substantially intermediate the length thereof and also connected to an adjacent mounting means and each of said stabilizing means for allowing the ski to which it is connected to pivot relative to the hull in a vertical plane about the connection between the stabilizing means and the ski so that an angle between the long axis of the ski and the long axis of the hull may change, and e. a pair of shock absorber means for damping out vibrations from said resilient means one of said shock absorber means disposed on said port side and the other shock absorber means disposed on said starboard side, and each of said shock absorber means being operatively connected to a ski and to a mounting means.

2. The marine vehicle as described in claim 1 wherein an elastic means is provided on each of said port and starboard sides of said marine vehicle, each of said elastic means having one end thereof secured to a forward portion of a ski and the other end thereof adapted to be secured to said marine vehicle; said elastic means preventing said forward portion of said skis from falling below a predetermined depth beneath the surface of a body of water when said marine vehicle is stationary upon the water.

* * * * *